US005079806A

United States Patent [19]

Allen

[11] Patent Number: 5,079,806

[45] Date of Patent: Jan. 14, 1992

[54] PIVOTAL COLSURE

[75] Inventor: Donovan J. Allen, Taylors, S.C.

[73] Assignee: Lasso L. P., Greenville, S.C.

[21] Appl. No.: 561,697

[22] Filed: Aug. 1, 1990

[51] Int. Cl.[5] ..... B65D 77/10

[52] U.S. Cl. ..... 24/30.5 R; 24/380; 24/517

[58] Field of Search ..... 24/30.5 R, 30.5 S, 30.5 P, 24/30.5 T, 30.5 L, 30.5 W, DIG. 28, DIG. 29, 570, 571, 517, 380, 49 CP, 49 P

[56] References Cited

U.S. PATENT DOCUMENTS

| | | | |
|---|---|---|---|
| 663,540 | 12/1900 | Hansen . | |
| 769,108 | 8/1904 | McPherson | 24/380 |
| 775,801 | 11/1904 | Danielson | 24/30.5 R |
| 1,370,468 | 3/1921 | Mandis | 24/49 CP |
| 1,459,735 | 6/1923 | Kraft . | |
| 3,036,506 | 5/1962 | Andresen, Jr. . | |
| 3,259,302 | 7/1966 | Rocchisani . | |
| 3,266,711 | 8/1966 | Song . | |
| 3,383,739 | 5/1968 | Pitzel | 24/517 |
| 3,384,938 | 5/1968 | O'Connor | 24/462 |
| 3,568,264 | 3/1971 | Crist et al. | 24/517 |
| 4,296,529 | 10/1981 | Brown . | |

FOREIGN PATENT DOCUMENTS

| | | | |
|---|---|---|---|
| 48302 | 2/1983 | United Kingdom | 24/DIG. 29 |

*Primary Examiner*—Victor N. Sakran
*Attorney, Agent, or Firm*—Dority & Manning

[57] ABSTRACT

A closure for pliant containers, such as bags and the like, which has an elongated closure body and an elongated closure arm that are pivotally attached to pivot in parallel planes. The body forms a U-shaped slot to receive a portion of the arm so that a pliant container can be sealingly closed between the body and the arm when a portion of the arm is received within the U-shaped slot of the body.

37 Claims, 3 Drawing Sheets

PIVOTAL COLSURE

BACKGROUND OF THE INVENTION

The present invention relates generally to closures for flexible containers, such as plastic or foil bags and the like, and more particularly to a novel pivotal closure which provides quick and effective closure of a pliant container.

For economy and convenience, many food items are packaged and sold in multi-serving pliant bags. Many of these type bags, for example potato chip bags, are heat sealed to protect the freshness of the product. After they have been opened, it is desirable to have a quick and effective means of closing the bag to preserve the freshness of the remaining product. In addition, it is desirable that the closure device can be used for the closure of many types of flexible bags, such as to encapsulate mechanical devices or garments in a flexible container with an air tight seal. It is also desirable that a closure be reusable, be easy to manufacture and use, and be inexpensive.

Certain closures are known in the prior art which attempt to address the problems expressed above. An example of such a device is set forth generally in U.S. Pat. No. 4,296,529. Such a device provides a hinged closure member including a ridge on one side and a channel on the other, with a snap fit locking means for holding the closure in a closed position.

U.S. Pat. No. 3,266,711 discloses a bag closure apparatus consisting of two portions which are matingly fitted together for receipt of the open end of a bag therebetween. The receiving member of the closure includes chamfered ends to facilitate insertion of the cylindrical male member. U.S. Pat. No. 1,459,735 discloses a pivotal closure for ice bags which includes a pivot on one end and a catch on the other for holding an open end of an ice bag therebetween. U.S. Pat. No. 663,540 discloses a bag tie consisting of two hook-shaped members pivotably attached for receipt of a bag. The device includes latch means on a free end for closing the hook-shaped members around a bag. U.S. Pat. No. 3,036,506 discloses a closure for sealing an underwater camera case. The device includes two members pivotably attached and including a hooking means to slide over the free end of one member for holding the device in a closed position. U.S. Pat. No. 3,259,302 also discloses a closure device.

Thus, the prior art has provided various means for sealing and resealing pliant containers adapted to be repeatedly opened by a consumer. However, none provide a device that can quickly, easily and effectively seal and release such bags in the manner of the present invention.

SUMMARY OF THE INVENTION

The present invention recognizes and addresses the foregoing disadvantages, and others, of the prior art bag closures. Accordingly, it is an object of the present invention to provide an improved closure for use on pliant containers, such as plastic and foil bags and the like.

It is another object of the present invention to provide an improved closure device which allows for quick and effective closure of a pliant container.

It is a further object of the present invention to provide a bag closure device which can effectively seal a pliant container that is placed within said closure device with no preparation such as twisting, folding or flattening required.

It is another object of the present invention to provide a closure device for pliant containers which seals the pliant container when held by the closure device.

It is a further object of the present invention to provide a closure device which can be used and reused on pliant containers of various sizes.

These and other objects are achieved generally by providing a closure for pliant containers such as bags and the like which has an elongated closure body and an elongated closure arm arranged generally parallel to the body and pivotally connected at one end thereto for movement in a plane parallel to the body. One of the body and the arm define a slot at an end of same opposite said pivotal connection for receipt of a like end of the other of the body and the arm. The closure also includes means for securing the other of the body and arm within the slot when a portion of a pliant container is located between medial portions of the body and the arm to effectuate closing of the container thereby.

In a preferred embodiment, the slot may be U-shaped and defined by first and second spaced apart leg portions connected by an intermediate portion. The means for securing the other of the body and arm within the slot may comprise frictional engagement between the portion of the body or arm defining a slot and the like end of the other of said body and arm. It is also preferred that one or both of the body and arm are flexible and that the frictional engagement is at least partly resultant from the pliant container biasing one or both of the body or arm.

At least one of the body and arm may include reinforcing ribs thereon. It is also preferred that at least certain of the edges adjacent the entrance to the slot are beveled to facilitate entry of the like end of the other of said body and arm. Further, at least certain of the edges of the like end of the other of the body and arm may be beveled to facilitate entry into the slot. Further, at least one of the elongated body and arm may include beveled edges adjacent its medial portion to facilitate sealing of the pliant container.

In another preferred embodiment, the means for securing the other of the body and arm within the slot include locking means for maintaining the like end of the other of the body and arm in the slot when the closure is in the closed position. The locking means may includes a protrusion extending from the one of the body and arm defining a slot into the slot and a receiving portion on the like end of the other of the body and arm for receipt of the protrusion when the closure is in the closed position. The receiving portion may be an opening such as a hole or a channel.

In another preferred embodiment, a slot may be defined on both ends of the closure, either on the body or the arm, or on the arm on one end and on the body on the other end. Each slot may include at least one protrusion extending from the body or the arm into the slot. Each end of the other of the body or arm that does not define a slot may include an opening for receipt of the one or more protrusions so as to pivot on one end and to receive the protrusion for locking engagement on the other end.

The individual members of the closure may be of unitary construction for ease of manufacture and polymeric for desired resilience, although any other material is also within the scope of the present invention.

It should be understood to one of ordinary skill in the art that features of the various embodiments may be interchanged. Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification including reference to the accompanying figures in which.

Figure 1:
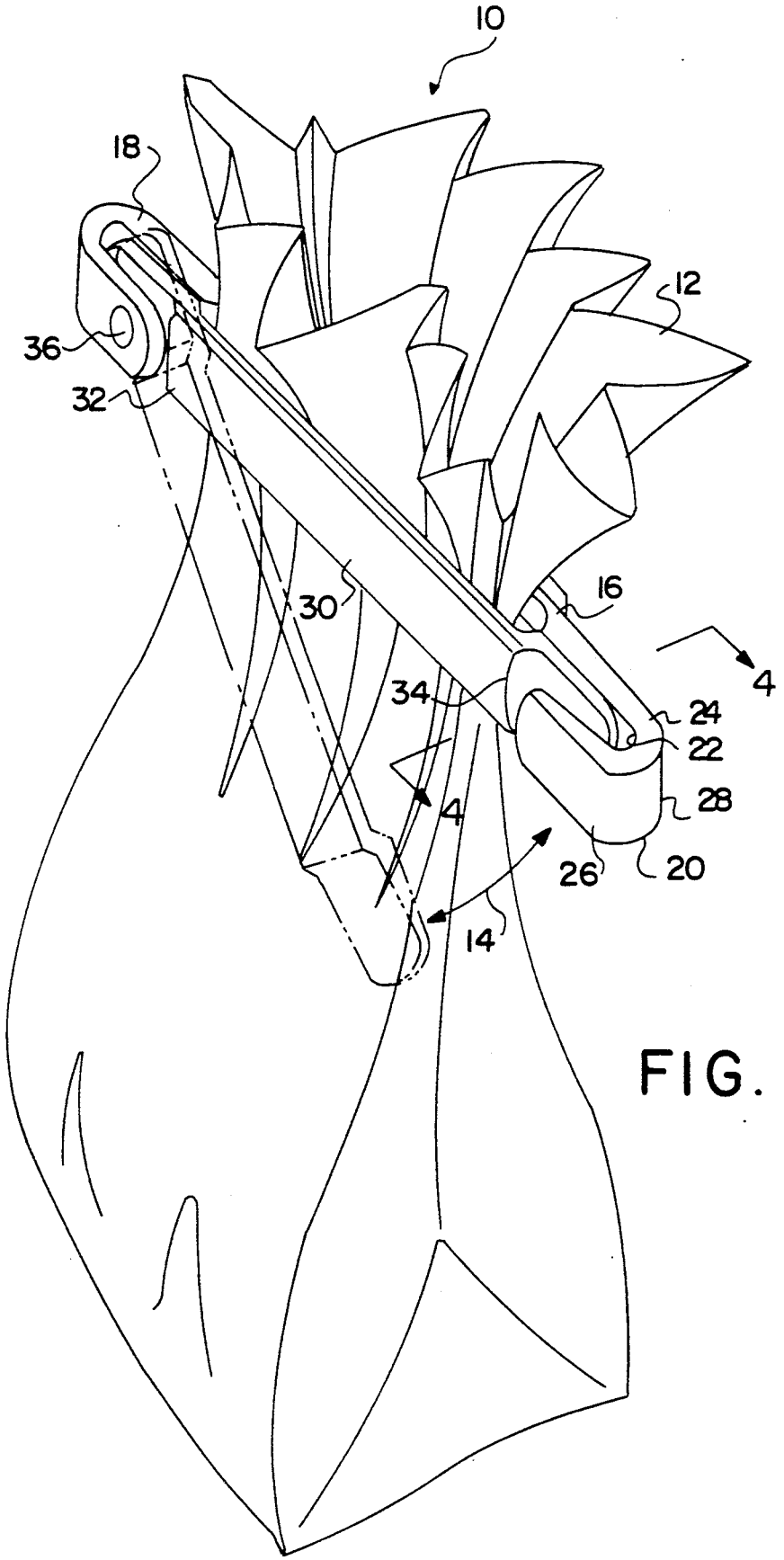
FIG. 1 is a perspective view of a bag closure in accordance with the, present invention shown with a bag and with arrows indicating the direction of pivot of the elongated closure arm with respect to the device.

The accompanying drawings, which are incorporated in and constitute a part of this Specification, illustrate embodiments of the invention and, together with the description, serve to explain the principles of the invention. Repeat use of reference characters in the present specification and drawings is intended to represent same or analogous features or elements of the invention.

DETAILED DESCRIPTION OF PREFERRED EMBODIMENTS

It is to be understood by those of ordinary skill in the art that the present discussion is a description of exemplary embodiments only, and is not intended as limiting the broader aspects of the present invention, which broader aspects are embodied in the exemplary constructions.

Figure 2:
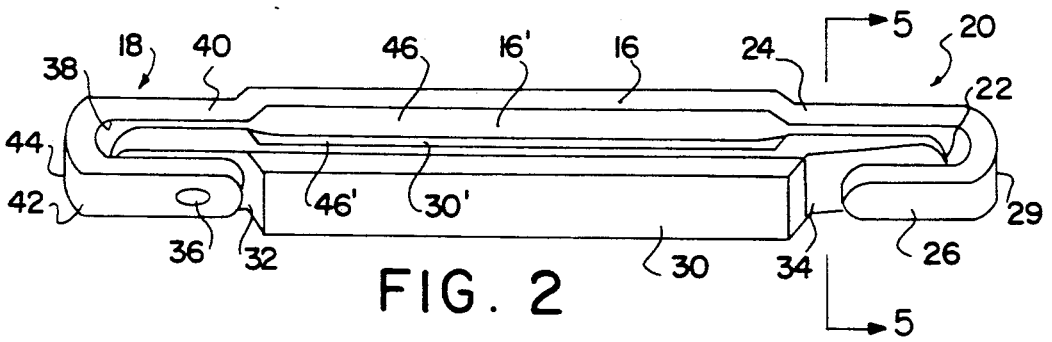
FIG. 2 is a perspective view of a bag closure in accordance with the present invention.

Referring to FIG. 1, a closure 10 for pliant containers, such as a bag 12, is illustrated. The closure is shown in a closed position in solid lines and by dotted lines in an open position, with arrow 14 generally indicating the direction of pivot from closed to open position. As best illustrated in FIGS. 1 and 2, the closure includes a closure body 16 with first end 18 and second end 20. Second end 20 includes a U-shaped slot 22 which is defined by a first leg portion 24 and a second spaced apart leg portion 26, with the leg portions being connected by an intermediate portion 28. As can clearly be seen in FIG. 2, first leg portion 24 extends in the same plane as closure body 16 and second leg portion 26 extends in a plane substantially parallel to closure body 16 and leg portion 24.

As further best illustrated in FIGS. 1 and 2, closure 10 also includes a closure arm 30. Closure arm 30 includes a first end 32 and a second end 34. As can clearly be seen from FIGS. 1 and 2, closure body 16 and closure arm 30 are elongated. First end 32 of closure arm 30 is pivotably connected to first end 18 of closure body 16 for movement in a plane parallel to the plane in which the closure body extends. Closure arm 30 pivots with respect to closure body 16 about a pivot 36, with a pivot axis extending transverse to the plane in which the closure body extends and the plane parallel to that plane in which closure arm 30 pivots. Second end 34 of closure arm 30 is adapted for receipt between the two leg portions 24 and 26 of closure body 16 when closure 10 is in a closed position as indicated in solid lines in FIG. 1. The closure includes means for securing the arm within the slot.

Closure arm 30 is flexible and is maintained in the closed position as shown in solid lines in FIG. 1 by the means for securing the arm within the slot which, in this embodiment, comprises frictional engagement between closure arm 30 and the inside surface of the second leg portion 26 of closure body 16, as a result of a portion of the pliant container or bag 12 being located between body portion 16' and closure arm portion 30', and biasing closure arm 30 outwardly causing second end 34 of same to make tighter engagement with the inside surface of leg 26. Because of this relationship, a portion of a pliant container or bag 12 can be closed and sealed between closure body portion 16' and closure arm portion 30' when portion 34 of arm 30 is located within U-shaped slot 22.

As best shown in FIG. 2, closure body 16 may also define a second U-shaped slot 38 on its first end. Second U-shaped slot 38 is defined by first leg portion 40 and second leg portion 42 of body 30 connected by an intermediate portion 44. First leg portion 40 extends in the same plane as closure body 16 and second leg portion 42 extends in a plane parallel to the plane in which first leg portion 40 and closure body 16 extend. In this embodiment, first end 32 of closure arm 30 is received within U-shaped slot 38 and pivotably attached by pivot pin 36. Pivot pin 36 can be a pin, bolt, brad or any other member to pivotally secure the body and arm together.

Figure 4:
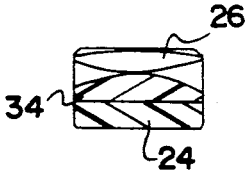
FIG. 4 is a cross-sectional view of FIG. 1 taken along lines 4—4.
Figure 5:
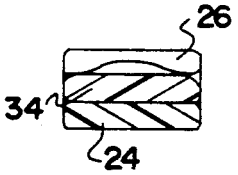
FIG. 5 is a cross-sectional view of FIG. 2 taken along lines 5—5.

As best shown in FIG. 2, in a preferred embodiment, middle portions 16' and 30' respectively of closure body 16 and closure arm 30 include beveled portions 46, 46' which may be present on one or both sides, and on one or both of the body and arm, to facilitate the closing of arm 30 with a portion of a bag 12 between arm 30 and body 16. Also in a preferred embodiment, as best illustrated in FIGS. 2, 4 and 5, second leg portion 26 of closure body 16 may also be beveled to facilitate movement of closure arm 30 into locking engagement with leg 26. In addition, second end 34 of the closure arm may include a beveled or tapered portion to further facilitate engagement with the second leg portion of closure body 16. Furthermore, second leg portion 26 and second end 34 may both be beveled to facilitate easier closing of the closure 10. As best illustrated in FIG. 5, it is also within the scope of this invention for either second leg portion 26 or second end of the closure arm 34 to be beveled or tapered with its mating piece remaining straight.

Sliding engagement between the second leg portion 26 and the second end of the closure arm 34, when either are beveled, serves to wedge the closure into a closed position as the arm pivots from an open position to a closed position. This allows the arm to more easily pivot into the closed position when a bag is located between the arm and body because the wedging action caused by the beveled surfaces allows for a larger opening between the arm and body as the arm is initially received within the slot. The beveled surface or surfaces then wedge the arm toward the body to tightly seal the bag.

Figure 3:
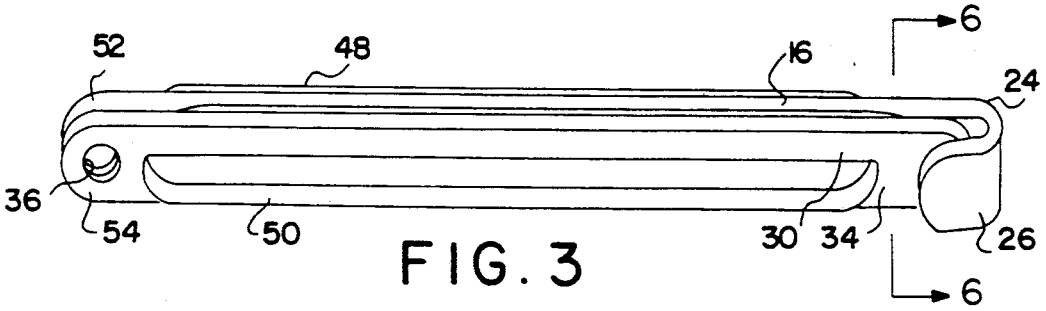
FIG. 3 is a perspective view of another embodiment of a bag closure in accordance with the present invention.

In another preferred embodiment of the invention, as best illustrated in FIG. 3, closure body 16 and closure arm 30 may include reinforcing ribs 48 and 50 for enhanced support of the body and arm. Either or both of the closure members may include reinforcing ribs as illustrated in FIG. 3. As further illustrated in FIG. 3, in an alternate embodiment, the first end 52 of closure body 16 may be substantially straight and directly pivotably attached through pivot 36 to the first end 54 of the closure arm 30, without the U-shaped arrangement as described with regard to the previous embodiment.

Figure 6:
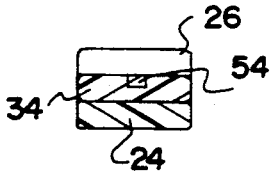
FIG. 6 is a cross-sectional view of FIG. 3 taken along lines 6—6.

As illustrated in FIG. 6, second leg portion 26 and second end 34 of closure arm 30 may be substantially straight and not beveled or tapered. In addition, as illustrated in dotted lines in FIG. 6, either second leg portion 26 or second end 34 of closure arm 30 may include a locking means for maintaining the closure arm in locking engagement within U-shaped slot 28 as generally illustrated in FIG. 6 as a tab 54. Such a locking means could take any form that would provide additional security between the closure arm and the U-shaped slot including that form illustrated in FIGS. 7 and 10 and discussed below.

Figure 7:
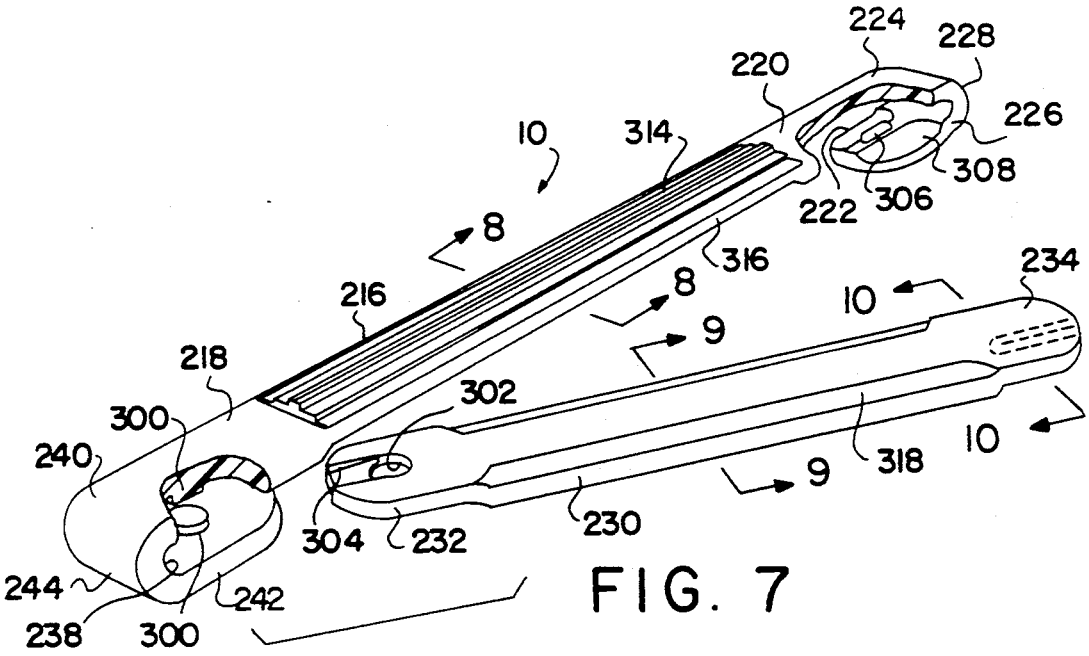
FIG. 7 is a perspective view with cut away portions of a further preferred embodiment of the present invention.

FIGS. 7–10 illustrate another preferred embodiment of closure 10. As illustrated in FIG. 7, closure body 216 includes first end 218 and second end 220. First end 218 includes U-shaped slot 238 which is defined by first leg portion 240 and second leg portion 242 connected by an intermediate portion 244. First leg portion 240 extends in the same plane as closure body 216, and second leg portion 242 extends in a plane parallel to the plane in which first leg portion 240 and closure body 216 extend.

As further illustrated particularly in FIG. 7, closure body 216 may also define a U-shaped slot 222 on its second end which is defined by a first leg portion 224 and a second spaced apart leg portion 226 with the leg portions being connected by an intermediate portion 228. As can clearly be seen in FIG. 7, first leg portion 224 extends in the same plane as closure body 216, and second leg portion 226 extends in a plane substantially parallel to closure body 216 and leg portion 224.

As can be seen from FIG. 7, closure body 216 and closure arm 230 are elongated. First end 218 of closure body 216 includes one or more protrusions 300 which extend into U-shaped slot 238 from one or both of the inside surfaces of legs 240, 242. The one or more protrusions 300 function as pivot pins to pivotally attach body 216 and arm 230.

As further best illustrated in FIG. 7, the closure also includes closure arm 230. Closure arm 230 includes first end 232 and second end 234. First end 232 of closure arm is adapted to be pivotally connected to first end 218 of closure body 216 for movement in a plane parallel to the plane in which the closure body extends. First end 232 of arm 230 defines an opening 302 for receipt of protrusions 300 to form a pivotal connection between arm 230 and body 216. First end 232 of arm 230 also includes a tapered channel 304 extending from the terminus 322 of the first end of arm 230 to the opening 302. Tapered channel 304 is adapted to slidingly engage protrusions 300 to bias the U-shaped slot open to a point where protrusions 300 engage the opening 302 to form a secure pivotal connection between body 216 and arm 230. Tapered channel 304 is sloped to provide increasing bias for the U-shaped slot as the protrusions approach opening 302.

Closure arm 230 pivots with respect to closure body 216 about protrusions 300, with a pivot axis extending transverse to the plane in which the closure body extends and the parallel plane to that plane in which closure arm 30 pivots. Second end 234 of closure arm 230 is adapted for receipt between the two leg portions 224 and 226 of closure body 216 when the closure is in a closed position as indicated in solid lines in FIG. 1. Second leg portion 226 of body 216 includes a protrusion 306 extending into U-shaped slot 222. Second leg portion 226 is also beveled as illustrated at 308 to facilitate movement of the second end of arm 230 into the U-shaped slot.

Figure 10:
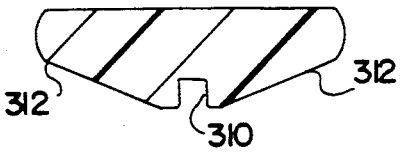
FIG. 10 is a cross-sectional view of FIG. 7 taken along lines 10—10.

As best illustrated in FIGS. 7 and 10, second end 234 of arm 230 is beveled and includes an opening 310 for engagement with protrusion 306 when the closure is in a closed position. The opening 310 and one or more protrusions will be biased into contact by the flexing action of the arm caused by the portion of a pliant container received between the body and arm when the closure is in a closed position. Beveled portions 312 of arm 230 are adapted for sliding engagement with beveled portions 308 of the body to facilitate sliding engagement between second end 234 and second leg portion 226 for locking the closure in a closed position. The sliding engagement between surfaces 312 and 308 serve to wedge the arm into a closed position as the arm pivots toward a closed position. Beveled portions allow the arm to more easily pivot into the closed position when a pliant container is located between the arm and body because the wedging action allows for a larger opening between the arm and body as the arm is initially received within the slot. The beveled surfaces then wedge the arm closed as it pivots into the slot to tightly seal the pliant container.

Figure 8:
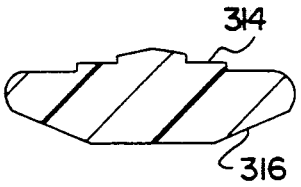
FIG. 8 is a cross-sectional view of FIG. 7 taken along lines 8—8.

As best illustrated in FIG. 8, the body may include one or more ridges or ribs 314 which act to reinforce the body and facilitate handling of the closure with fingers. As further illustrated in FIG. 8, the body may also define beveled edges 316 adjacent its medial inner surface.

Figure 9:
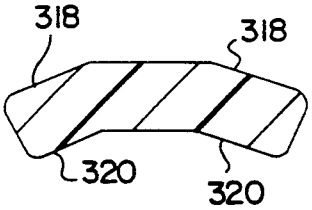
FIG. 9 is a cross-sectional view of FIG. 7 taken along lines 9—9.

As best illustrated in FIG. 9, arm 230 defines beveled edges 318 which act in conjunction with beveled edges 316 on the body to assist in compressing the layers of a pliant container placed therebetween. The beveled edges 316 and 318 also work together to lessen the scissors action which could otherwise cut the pliant container as the arm and body are pivoted together. Arm 230 also includes grip enhancing portions 320 which may extend from the outer surface of arm 230 to provide for easy maneuverability of the arm with the thumb or finger. These grip enhancing portions may take the form of triangular elongated protrusions on opposite edges of the arm as illustrated at 320 in FIG. 9.

Figure 11:
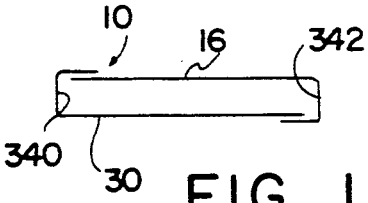
FIG. 11 is a schematic side view of a further preferred embodiment of the present invention where the body defines one slot and the arm defines another.

FIG. 11 schematically illustrates a further embodiment of the present invention. As illustrated in FIG. 11, closure 10 may include a slot 340 defined by the arm 30 and a slot 342 defined by the body 16. Either end of the arm and body could then be pivotally attached as described above. Further, all features of the other preferred embodiments of this invention could be incorporated in this embodiment.

These and other modifications and variations to the present invention may be practiced by those of ordinary skill in the art, without departing from the spirit and scope of the present invention, which is more particularly set forth in the appended claims. The embodiments disclosed herein and portions thereof may be interchangeably used with all other embodiments disclosed. Furthermore, those of ordinary skill in the art will appreciate that the foregoing description is by way of example only, and is not intended to be limitative of the invention so further described in such appended claims.

What is claimed is:

1. A closure for pliant containers such as bags and the like comprising:

an elongate closure body and an elongated closure arm arranged generally parallel to said body and being pivotally connected at one end thereto for movement in a plane parallel to said body, one of said body and said arm defining a slot at an end of same opposite said pivotal connection for receipt of a like end of the other of said body an said arm, said slot being open on at least one side and being defined by first and second spaced apart leg portions; and means for securing the other of said body and said arm within said slot when a portion of a pliant container is located between medial portions of said body and said arm to effectuate closing of said container thereby.

2. A closure for pliant containers as in claim 1, wherein said slot is U-shaped.

3. A closure for pliant containers as in claim 1, wherein said means for securing the other of said body and said arm within said slot comprises frictional engagement between the portion of the body or arm defining a slot and the like end of the other of said body and arm.

4. A closure for pliant containers as in claim 3, wherein said arm is flexible and said frictional engagement is at least partly resultant from said pliant container biasing the arm.

5. A closure for pliant containers as in claim 3, wherein said body is flexible and said frictional engagement is at least partly resultant from said pliant container biasing the body.

6. A closure for pliant containers as in claim 3, wherein said body and said arm are flexible and said frictional engagement is at least partly resultant from said pliant container biasing the body and arm.

7. A closure for pliant containers as in claim 1, wherein at least one of said body and arm includes reinforcing ribs thereon.

8. A closure for pliant containers as in claim 1, wherein at least certain of the edges adjacent the entrance to the slot are beveled to facilitate entry of the like end of the other of said body and arm.

9. A closure for pliant containers as in claim 1, wherein at least certain of the edges of the like end of the other of said body and arm are beveled to facilitate entry into the slot.

10. A closure for pliant containers as in claim 1, wherein at least certain of the edges adjacent the entrance to the slot are beveled and at least certain of the edges of the like end of the other of said body and arm are beveled to facilitate entry into the slot.

11. A closure for pliant containers as in claim 1, wherein at least one of said elongated body and arm includes beveled edges adjacent its medial portion to facilitate sealing of the pliant container.

12. A closure for pliant containers as in claim 1, wherein said means for securing the other of said body and said arm comprises locking means for maintaining the like end of the other of said body and arm in the slot when the closure is in the closed position.

13. A closure for pliant containers as in claim 12, wherein said locking means includes a protrusion extending from said one of said body and said arm defining a slot into the slot and a receiving portion on the like end of the other of said body and arm for receipt of the protrusion when the closure is in the closed position.

14. A closure for pliant containers as in claim 13, wherein said receiving portion is an opening.

15. A closure for pliant containers such as bags and the like, comprising:

an elongated closure body having a first and second end, said second end terminating in a U-shaped slot;

an elongated closure arm having a first and second end, said first end being pivotably attached to said closure body first end so that said closure body and arm pivot in substantially parallel planes;

said closure arm second end being adapted for engagement with the portion of said closure body defining said U-shaped slot when a portion of a pliant container is located between said closure body and arm so that a pliant container can be closed therebetween; and wherein said closure arm second end can pivot through said U-shaped slot when no pliant container is located between said closure member body and arm.

16. A closure for pliant containers as in claim 15, wherein said closure arm is biased into frictional engagement with the portion of said closure body defining said U-shaped slot when a pliant container is located between said closure body and arm and said arm is pivoted into the U-shaped slot.

17. A closure as in claim 16, wherein at least one of said closure body and arm includes reinforcing ribs thereon.

18. A closure as in claim 15, wherein at least certain of the edges adjacent said U-shaped slot are beveled to facilitate entry of the arm into the slot.

19. A closure as in claim 18, wherein the engagement between the closure arm second end and the portion of said closure body defining said U-shaped slot is frictional.

20. A closure for pliant containers such as bags and the like, comprising:

an elongated closure body with a first and second end, and defining a U-shaped slot on said second end, said U-shaped slot being defined by first and second spaced apart leg portions and connected by an intermediate portion, said first leg portion extending in the same plane as said closure body and said second leg portion extending in a plane parallel to said closure body;

an elongated closure arm with a first and second end, said first end being pivotally connected to the first end of said closure body for movement in a plane parallel to the plane in which the closure body extends, about an axis extending transverse to said plane in which the closure body extends and said parallel plane, and said second end adapted for receipt between said two leg portions of said U-shaped slot, wherein at least one of said closure arm or body is flexible and said closure is maintained in a closed position by engagement between said closure arm and said second leg portion resultant from a portion of a pliant container biasing said closure arm into contact with said leg portion when a pliant container is received between said closure body and arm, wherein a portion of a pliant container can be sealingly closed between said closure body and arm when a portion of said arm is received within said U-shaped slot.

21. A closure for pliant containers as in claim 20, wherein at least some of the portions defining said U-shaped slot include beveled edges to facilitate the frictional engagement between said closure arm and said second leg portion of said U-shaped slot.

22. A closure for pliant containers as in claim 20, wherein said second end of said elongated closure arm includes beveled edges to facilitate entry of the arm into the U-shaped slot.

23. A closure for pliant containers as in claim 20, wherein at least some of the portions defining said U-shaped slot include beveled edges and said second end of said closure arm includes beveled edges to facilitate entry of the arm into the slot.

24. A closure for pliant containers as in claim 20, wherein at least one of said closure body and arm includes a beveled medial portion to facilitate engagement of a portion of the pliant container.

25. A closure for pliant containers as in claim 20, when said closure is constructed of polymeric material.

26. A closure for pliant containers as in claim 20, wherein the engagement between said closure arm and said second leg portion is frictional.

27. A closure for pliant containers such as bags and the like, comprising:

an elongated closure body with a first and second end, and defining a U-shaped slot on said second end, said U-shaped slot being defined by first and second spaced apart leg portions and connected by an intermediate portion, said first leg portion extending in the same plane as said closure body and said second leg portion extending in a plane parallel to said closure body;

an elongated closure arm with a first and second end, said first end being pivotally connected to the first end of said closure body for movement in a plane parallel to the plane in which the closure body extends, about an axis extending transverse to said plane in which the closure body extends and said parallel plane, and said second end adapted for receipt between said two leg portions of said U-shaped slot, wherein at least one of said closure arm or body is flexible and said closure is maintained in a closed position by engagement between said closure arm and said second leg portion resultant from a portion of a pliant container biasing said closure arm into contact with said leg portion when a pliant container is received between said closure body and arm, wherein a portion of a pliant container can be sealingly closed between said closure body and arm when a portion of said arm is received within said U-shaped slot; and wherein said elongated closure body defines a U-shaped slot on its first end for pivotal receipt of the first end of the arm therein.

28. A closure for pliant containers such as bags and the like, comprising:

an elongated closure body with a first and second end, and defining a U-shaped slot on said second end, said U-shaped slot being defined by first and second spaced apart leg portions and connected by an intermediate portion, said first leg portion extending in the same plane as said closure body and said second leg portion extending in a plane parallel to said closure body;

an elongated closure arm with a first and second end, said first end being pivotally connected to the first end of said closure body for movement in a plane parallel to the plane in which the closure body extends, about an axis extending transverse to said plane in which the closure body extends and said parallel plane, and said second end adapted for receipt between said two leg portions of said U-shaped slot, wherein at least one of said closure arm or body is flexible and said closure is maintained in a closed position by engagement between said closure arm and said second leg portion resultant from a portion of a pliant container biasing said closure arm into contact with said leg portion when a pliant container is received between said closure body and arm, wherein a portion of a pliant container can be sealingly closed between said closure body and arm when a portion of said arm is received within said U-shaped slot; and wherein said elongated closure arm defines a U-shaped slot on its first end for pivotal receipt of the first end of said closure body therein.

29. A closure for pliant containers such as bags and the like, comprising:

an elongated closure body with a first and second end, and defining a U-shaped slot on said first and second end, said U-shaped slots being defined by first and second spaced apart leg portions and connected by intermediate portions, said first leg portions extending in the same plane as said closure body and said second leg portions extending in a plane substantially parallel to said closure body;

said first end of the elongated closure body including at least one protrusion extending into said first end U-shaped slot;

said second end of the elongated closure body including at least one protrusion extending into said second end U-shaped slot;

an elongated closure arm with a first and second end, said first end defining an opening for receipt of said at least one protrusion extending into said first end U-shaped slot so that the closure arm is pivotally connected to the first end of said closure body for movement in a plane parallel to the plane in which the closure body extends; and said second end adapted for receipt between said two leg portions of said second end U-shaped slot and defining an opening for receipt of said at least one protrusion extending into said second end U-shaped slot, wherein a portion of a pliant container can be sealingly closed between said closure body and arm when a portion of said arm is received within said U-shaped slot.

30. A closure for pliant containers as in claim 29, wherein said first end of said closure arm includes a channel adjacent said opening, said channel being adapted for sliding engagement with said at least one protrusion extending into said first end U-shaped slot to facilitate the pivotal connection between said closure body and arm.

31. A closure for pliant containers as in claim 29, wherein said first end closure arm channel is tapered so that said protrusion extending into said first end U-shaped slot will be biased outward by the taper and bias the U-shaped slot open to facilitate the connection between the at least one protrusion and the opening.

32. A closure for pliant containers as in claim 31, wherein a plurality of protrusions extend into said first end U-shaped slot from opposite leg portions, and said channel is tapered on both sides of the arm.

33. A closure for pliant containers as in claim 29, wherein said at least one protrusion extending into said second U-shaped slot extends from said second leg portion.

34. A closure for pliant containers as in claim 33, wherein at least certain of the edges of said second leg portion are beveled to facilitate engagement with a portion of said closure arm.

35. A closure for pliant containers as in claim 29, wherein at least certain of the edges adjacent said second end of said closure arm are beveled adjacent said opening to facilitate engagement with said at least one protrusion in said second U-shaped channel.

36. A closure for pliant containers as in claim 29, wherein at least one of said body and arm include raised portions for facilitating movement of the closure between open and closed positions.

37. A closure for pliant containers as in claim 29, wherein said closure is constructed of polymeric material.

* * * * *